US012037159B2

(12) United States Patent
Morris, Jr. et al.

(10) Patent No.: US 12,037,159 B2
(45) Date of Patent: Jul. 16, 2024

(54) PALLET SUBSTITUTE WITH PALLET BLOCKS

(71) Applicants: Glenn H. Morris, Jr., Chattanooga, TN (US); Darrell Davis, Hixson, TN (US); Travis Peacock, Chattanooga, TN (US)

(72) Inventors: Glenn H. Morris, Jr., Chattanooga, TN (US); Darrell Davis, Hixson, TN (US); Travis Peacock, Chattanooga, TN (US)

(73) Assignee: M & M Industries, Inc., Chattanooga, TN (US)

( * ) Notice: Subject to any disclaimer, the term of this patent is extended or adjusted under 35 U.S.C. 154(b) by 140 days.

(21) Appl. No.: 17/846,169

(22) Filed: Jun. 22, 2022

(65) Prior Publication Data

US 2022/0402648 A1 Dec. 22, 2022

Related U.S. Application Data

(60) Provisional application No. 63/213,434, filed on Jun. 22, 2021.

(51) Int. Cl.
*B65D 19/00* (2006.01)
*B65D 19/20* (2006.01)

(52) U.S. Cl.
CPC ..... *B65D 19/0012* (2013.01); *B65D 19/20* (2013.01); *B65D 2519/00019* (2013.01); *B65D 2519/00069* (2013.01); *B65D 2519/00273* (2013.01); *B65D 2519/00323* (2013.01)

(58) Field of Classification Search
CPC ..... B65D 19/00; B65D 19/20; B65D 2519/0019; B65D 2519/00069; B65D 2519/00273; B65D 2519/00323
USPC ..... 108/51.3, 57.12, 56.3
See application file for complete search history.

(56) References Cited

U.S. PATENT DOCUMENTS 3,267,882 A * 8/1966 John ..... B60V 3/02 108/51.11
3,275,131 A * 9/1966 Erickson ..... F16F 1/37 267/141
3,351,027 A * 11/1967 Ellard, Jr. ..... B65D 19/0028 248/631
3,426,986 A * 2/1969 Clarence ..... A47B 91/04 248/188
3,685,463 A * 8/1972 Francis ..... B65D 19/0028 108/56.3
3,804,032 A * 4/1974 Baucom ..... B65D 19/0028 108/56.3
4,687,079 A * 8/1987 Gladish ..... B65G 15/60 406/88
5,588,371 A * 12/1996 Looker ..... B65D 19/0095 108/57.12

(Continued)

FOREIGN PATENT DOCUMENTS

CA 2582625 A1 * 9/2007 ..... B65D 19/0073

*Primary Examiner* — Jose V Chen
(74) *Attorney, Agent, or Firm* — Miller & Martin PLLC

(57) ABSTRACT

A pallet substitute has pallet blocks, which may be made of plastic regrind or other material which can be utilized in conjunction with a tray, whether cardboard or otherwise, to provide a pallet. The pallet substitute may have pallet blocks that connect separately and directly to the tray, or pairs (or triples, etc.) of pallet blocks may connect together, possibly with stringers and connect to the tray.

18 Claims, 6 Drawing Sheets

(56) References Cited

U.S. PATENT DOCUMENTS 5,588,374 A * 12/1996 Urbach ..... B65D 19/0026 108/56.3
5,765,800 A * 6/1998 Watanabe ..... F16F 15/0232 248/550
6,418,862 B1 * 7/2002 Heil ..... B65D 19/0028 108/57.12
6,857,377 B2 * 2/2005 Herring ..... B65D 19/0018 108/51.11
7,637,219 B2 * 12/2009 Hartel ..... B65D 19/40 108/51.11
8,336,466 B2 * 12/2012 Mani ..... B65D 19/0073 108/57.32
9,932,144 B2 * 4/2018 Embleton ..... B65D 19/0012
10,059,487 B2 * 8/2018 Sun ..... F16F 1/374
2003/0037710 A1 * 2/2003 Monson ..... B65D 19/0012 108/57.12
2008/0115700 A1 * 5/2008 Creighton ..... B65D 19/36 108/57.25
2008/0250987 A1 * 10/2008 Hartel ..... B65D 19/0048 108/57.12
2011/0030588 A1 * 2/2011 Baechle ..... B65D 19/0026 108/51.3
2013/0180437 A1 * 7/2013 Wilcox ..... B65D 19/0012 29/426.6
2014/0086718 A1 * 3/2014 Bush ..... B65D 19/0073 414/800
2016/0023803 A1 * 1/2016 Green ..... B65D 19/0095 108/57.12
2016/0061285 A1 * 3/2016 Green ..... B65D 19/0028 267/141

* cited by examiner

PALLET SUBSTITUTE WITH PALLET BLOCKS

CLAIM OF PRIORITY

This application claims the benefit of U.S. Provisional Patent Application No. 62/213,434 filed Jun. 22, 2021, which is incorporated herein by reference in its entirety.

FIELD OF THE INVENTION

The present invention relates to pallets and more particularly to pallet blocks utilized to form pallets, often with paperboard (cardboard).

BACKGROUND OF THE INVENTION

Pallets provide a convenient way of assisting in the transport of goods from one location to another. These pallets can be made of plastic or wood, typically, and provide a way for forklifts to lift palletized goods for loading in vehicles to transport from one location to another. Pallets have been used for decades.

The price of lumber has driven the costs of wooden pallets upwards. For some palletized goods, a paperboard (cardboard) tray may be utilized at a bottom and a top of stacked goods. Some shipped goods are relatively light, such as empty pails for shipment by the manufacturer to a business that then fills the pails with goods and ships to their customers. For some uses, a relatively light duty pallet could be employed, potentially at a much cheaper cost than traditional pallet constructions which often have static load capacities exceeding 1000 kg, if not 3000 kg. However, no very lightweight (loading) pallets are believed to be available in the market.

Plastic manufacturers may have access to regrind (reground up product that either was excess inventory, faulty goods, or other plastic products re-ground into pellets or other form which can be melted and used for various purposes, such as blending with virgin plastic or other uses). While regrind can be used for various purposes and has value, it may not be as valuable for some applications as virgin plastic (such as polyethylene) normally used for plastic pails.

Whether a manufacturer has access to re-grind or not, a need exists for a relatively inexpensive pallet which could have at least some preferred uses.

Another need exists for an inexpensive very lightweight pallet or pallet substitute construction for at least some applications.

SUMMARY OF THE INVENTION

It is an object of many embodiments of the present invention to provide a set of pallet blocks which cooperate with a paperboard tray to provide a pallet substitute or a very lightweight pallet.

It is another object of the present invention to provide an improved pallet substitute.

It is another object of many embodiments of the present invention to provide sets of pallet blocks which cooperate with a paperboard tray to support palletized articles thereon.

It is yet another object of many embodiments of the present invention to provide a pallet substitute having a paperboard tray with cutouts or slots which receive pallet block clamps therethrough to secure pallet blocks to the paperboard tray to provide the pallet substitute to support palletized goods thereon.

Accordingly, in accordance with a first preferred embodiment of the present invention, a pallet substitute has sets of pallet blocks, each of which preferably have an integral clamp on (or extending from) an upper surface of each pallet block. The pallet blocks cooperate with preferably a paperboard (cardboard) tray which has cutouts or slots through which the arms, respectively, of the clamps extend therethrough and then extend substantially parallel to the tray floor thereby pallet blocks to the tray to support a bottom of the tray off of a horizontal surface, such as a floor, to provide access for forklift forks to pick up and move palletized goods on the pallet substitute. The clamps may have grips on an underside surface thereof which may contact an upper surface of the pallet tray to assist in retaining the pallet blocks at desired locations relative to the pallet tray.

The clamps may have a shoulder extending from an upper surface of a support member which extends the arm above the upper surface of the support member to permit the arm to extend through the slot and then preferably rest atop or at least extend along an upper surface of the tray possibly parallel to the upper surface of the support member. A lip at a cantilevered end of the arm may assist in directing the arm through the slot. The shoulder and/or arm may provide a living hinge to assist in flexing the cantilevered end of the arm away from the upper surface of the support member to extend through the slot during installation.

The support member of the pallet block also has what is believed to be a unique structure. A series of absorbing members are surrounded by an enclosing member. The enclosing member provides a perimeter about the series of absorbing members, four of which are shown with the enclosed figures, although other numbers could be utilized with other embodiments, such as two or more. The absorbing members have perimeters that preferably contacts either directly or indirectly the perimeter of the enclosing member at various locations along the top and bottom of the supporting member, if not also along the front and rear ends of the supporting member, at least when under a specified load.

When a load is applied to or through the upper surface of the support member, the absorbing members, being restrained by the enclosing member, support the load applied to the pallet block. In a prototype, a 90/1000 wall thickness of a support member having a height of 3.875 inches, a width of 4 inches and a length of 8 inches having four absorbing members with a height of slightly less than the height of the support member, widths substantially equal to the support member and lengths, which when added together are slightly less than the length of the support member easily support the weight of a 200 pound man. Six of these disposed proximate to a perimeter of the paperboard tray in parallel rows of three are believed to relatively easily support loads of less than about 500 pounds and possibly more. Four pallet blocks of this embodiment may be sufficient for some applications. It may be that for some embodiments, one or more middle rows may assist in distributing load. Each row need not have the same number or arrangement of pallet blocks.

However, for at least one customer of the applicant, 32 ECT cardboard pallet trays without pallets underneath are utilized to support loads of about 350 pounds of palletized goods (the customers' pallet forks are extremely sharply pointed and are slid by the operators under the trays to lift on site.

For at least some embodiments, a paperboard (cardboard) and/or other floor material may be placed atop an upper surface of the pallet tray thereby covering the arms of the pallet blocks.

The sides of the pallet blocks may be "open", particularly for ease of manufacture as they could be extruded from regrind and/or other plastic or other materials. Exterior surfaces, particularly the top and bottom of the enclosing member could be textured possibly having ridges extending away from the enclosing member or could be sandblasted or otherwise textured to assist in grip and/or prevent sliding.

The absorbing members are illustrated as being oval in cross section but could be other shapes for various embodiments. Furthermore, for at least some embodiments, adjacent absorbing members may share wall portions, possibly integrally, and absorbing members adjacently disposed to or in contact with the enclosing member may share wall portions so as to be integrally connected therewith. Other embodiments may have other structures or spaces spacing at least some of the absorbing members from each other and/or the enclosing member. It may be that only some of the absorbing members only contact the enclosing member when under load, either directly or indirectly for various embodiments.

While paperboard (cardboard) is the preferred material for pallet trays and floors, other material(s) could be utilized. Injection molded pallet blocks of HDPE (highly density polyethylene) such as regrind may constitute at least some pallet blocks.

As the applicant continued to revise preferred embodiments, connecting pallet blocks together became advantageous. A new design emerged with at least a first pallet block connected to a second pallet block with stringers, which may further provide support for a pallet tray/floor. In fact, this embodiment has a first pallet block that connects to a second pallet block in a first pallet block segment which cooperates with a similar second pallet block segment which has a first pallet block and a second pallet block. The second pallet blocks of the first and second pallet block segments may be adjacently disposed against one another, if not connected to each other and assist in providing support for the pallet substitute. The stringers of both first and second member may assist in supporting a pallet tray/floor as well above a floor and the bottom of the pallet blocks, for at least some embodiments.

BRIEF DESCRIPTION OF THE DRAWINGS

The particular features and advantages of the invention as well as other objects will become apparent from the following description taken in connection with the accompanying drawings in which.

DETAILED DESCRIPTION OF THE PREFERRED EMBODIMENT

Figure 1:
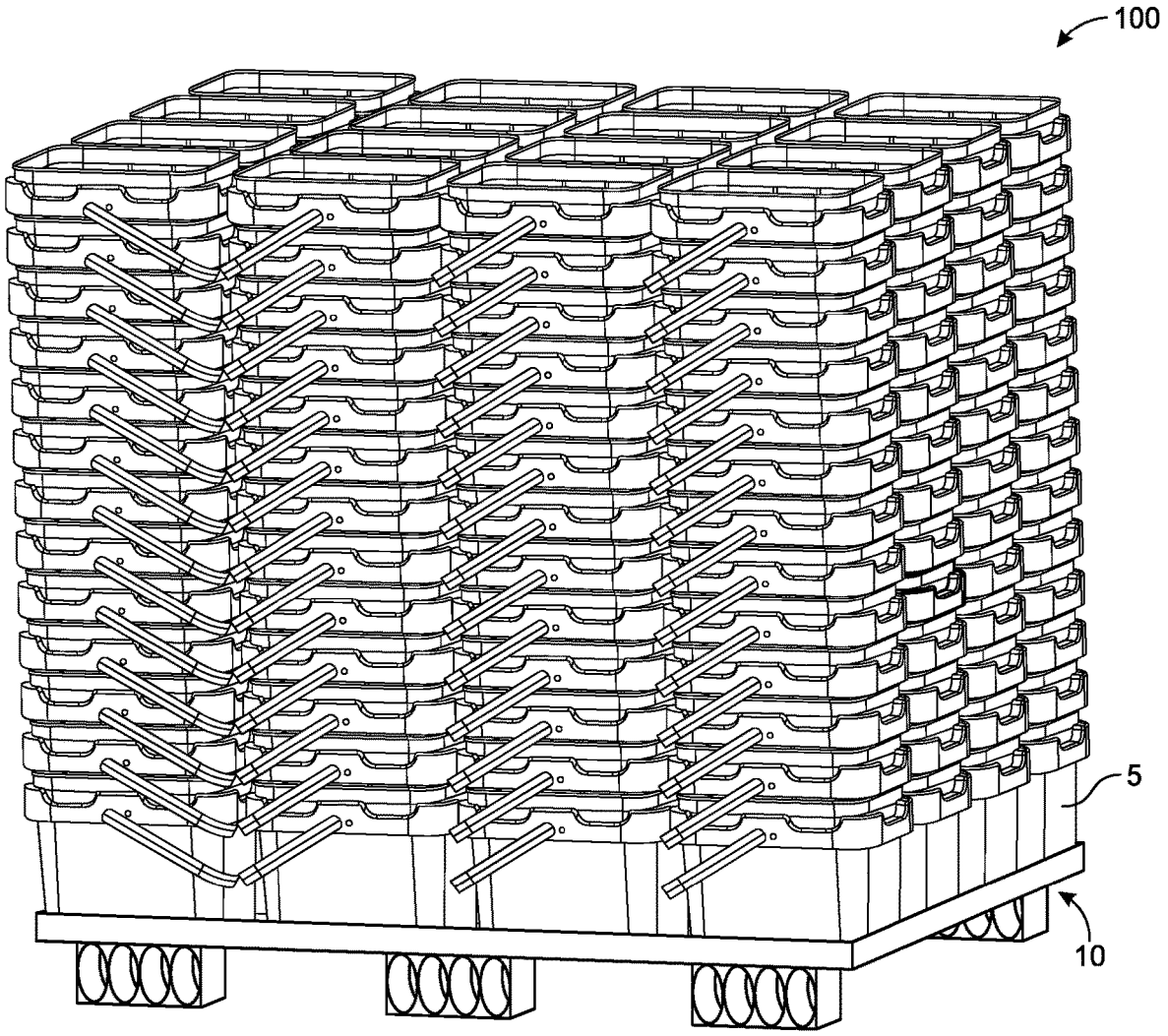
FIG. 1 is a side perspective view of a portion of a presently preferred embodiment of a loaded pallet substitute of the present invention.
Figure 2:
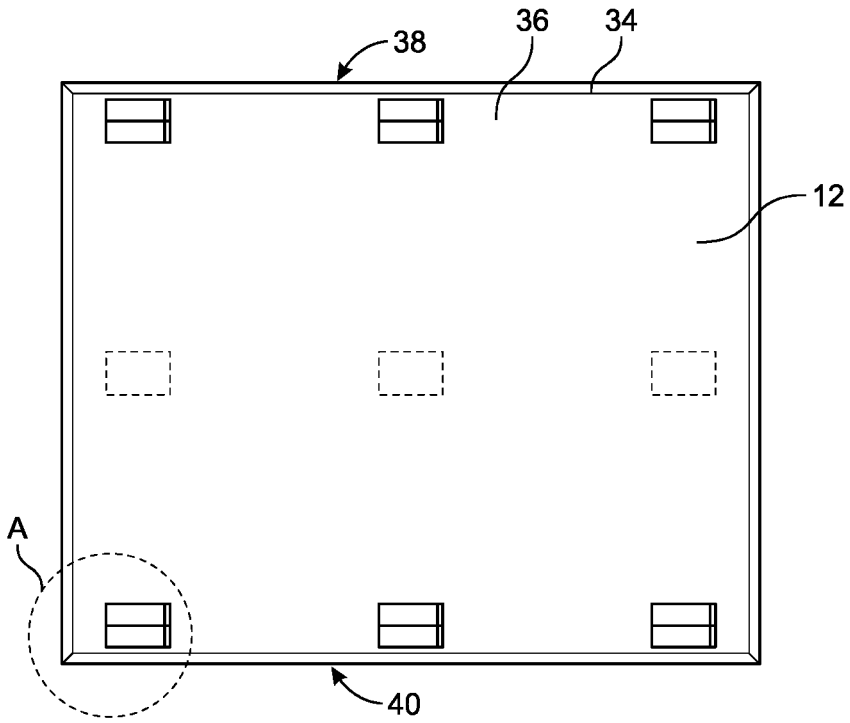
FIG. 2 is top plan view of a portion of the pallet substitute shown in FIG. 1.

FIG. 1 shows a palletized grouping 100 of products in the form of stacked pails 5 which would be provided from one company, possibly to another company that may fill the pails 5 with product and then ship to a retailer for sale to a customer. Stacked empty pails 5 do not weigh near as much as other palletized goods might weigh. The palletized grouping 100 illustrated might weigh between 350 and 450 pounds. Currently lightweight pallets of prior art constructions have a static load capacity of roughly 2000 pounds. Lightweight pallets, typically made of wood, are relatively expensive. A need exists for a more affordable, and possibly recyclable, or at least partially recyclable very lightweight pallet, or pallet substitute 10.

Figure 3:
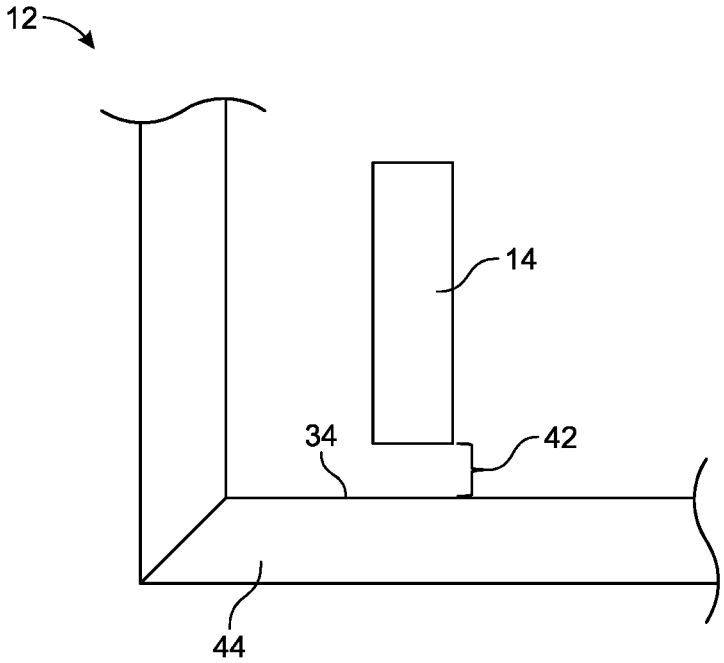
FIG. 3 is a detailed plan view of a corner of the pallet substitute shown in FIG. 2 before installing the pallet block.
Figure 6:
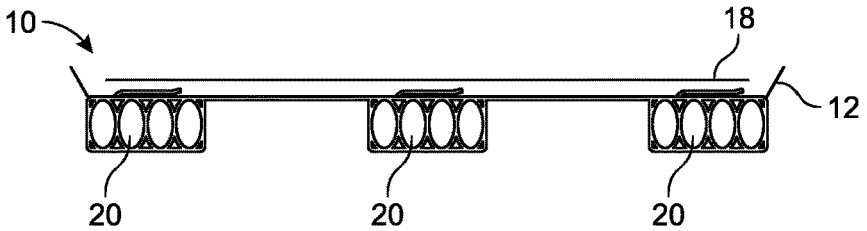
FIG. 6 is a side plan view of the pallet substitute of FIG. 1 with a floor being placed atop the tray.
Figure 7:
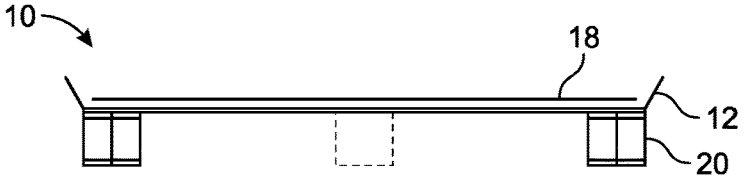
FIG. 7 is an end plan view of the pallet substitute of FIG. 1 with the floor on top of the tray.
Figure 8:
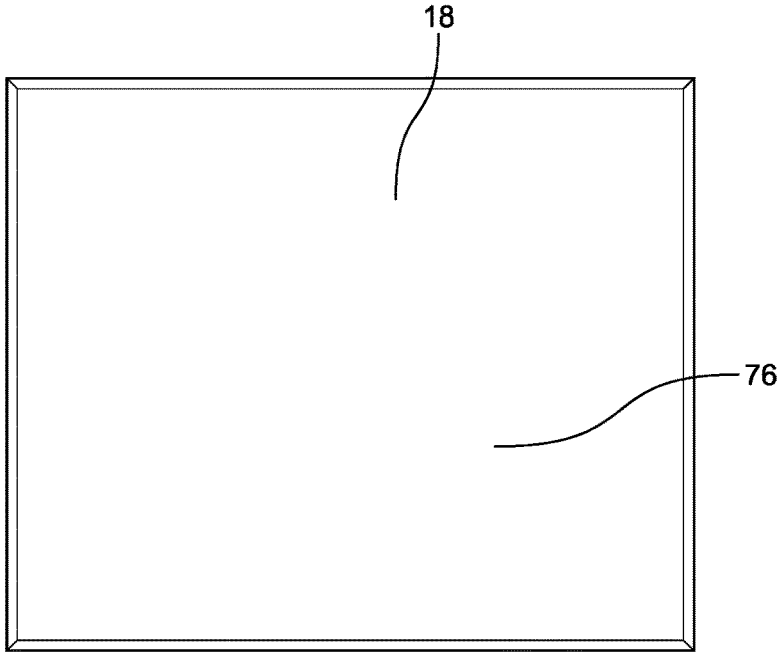
FIG. 8 is a top plan view of the floor on top of the tray of the pallet substitute of FIG. 1.

Pallet trays are widely used in the marketplace with continuous solid upper surfaces onto which product is loaded. However, the applicant has modified prior art designs to provide a pallet tray 12 which can form a portion of a very lightweight pallet or pallet substitute 10. The pallet tray 12 has a series, possibly an array, of slots 14 as shown in FIG. 3 through which a clamp 16 of a pallet block 20 extends therethrough, at least partially to assist in connecting the pallet blocks 20 to the pallet tray 12. This combination may complete the pallet substitute 10 or an optional floor 18 may be placed on top of the pallet tray 12 once the pallet blocks 20 are connected thereto such as shown better in FIGS. 6-8. More slots 14 may be provided than pallet blocks 20 attached so that a single pallet tray 12 may be utilized for multiple pallet configurations. Slots 14 may not necessarily be provided in an array for all embodiments.

The clamp 16 is preferably integral to the pallet blocks 20 for many embodiments. A shoulder 22 may extend upwardly from an upper surface 24 of an enclosing member 26, preferably a sufficient distance to accommodate a gap 28 for a cantileveredly connected arm 30 connected to the shoulder to receive a thickness of the pallet tray 12 once the arm 30 is extended through one of the slots 14 possibly parallel to upper surface 24. An upwardly angled or extending lip 32 may be useful to assist a user in connecting the clamp 16 to the pallet tray 14 to direct the respective arm 30 through the respective slot 14. One or more grips 34 may be useful extending from a lower surface 36 of the arm 30 to hold to the pallet tray 12 once installed to maintain the clamp 16 attached to the pallet tray 12 once installed. The upper surface 24 of the enclosing surface may be textured or otherwise have gripping components to assist the clamp 16 in holding to the pallet tray 12 once installed.

The slots 14 may or may not form an array, such as two rows of three slots so as to orient the pallet blocks at or proximate to a perimeter 34 of the holding surface 36 of the pallet tray 12. An optional third (or additional) row(s) may be utilized for various embodiments, and fewer or additional pallet blocks 20 may be utilized in slots 14 in the tray so as to support a palletized grouping 100 of a known weight. Preferably for most embodiments, at least two pallet blocks will be located along a first side 38 and at least two along a second side 40 of the pallet tray 12. Three pallet blocks 20 along or proximate to each side 38,40 has been found to be effective for at least some embodiments with E32 or more substantial pallet trays 12. The slots 14 are preferably spaced inwardly by spacing 42 from perimeter 34 of loading surface for at least some embodiments. Walls 44 may extend upwardly at perimeter 34 so as to potentially assist in loading the pallet tray 12 for at least some embodiments.

One of ordinary skill in the art will quickly see that regardless of the construction of the pallet blocks 20 apart from the clamp 16, the clamp 16, if utilized, can assist with pallet trays 12 having slots 14 to quickly assemble a pallet substitute 10 which can at least perform as a very lightweight pallet (in terms of loading, at a minimum).

Figure 4:
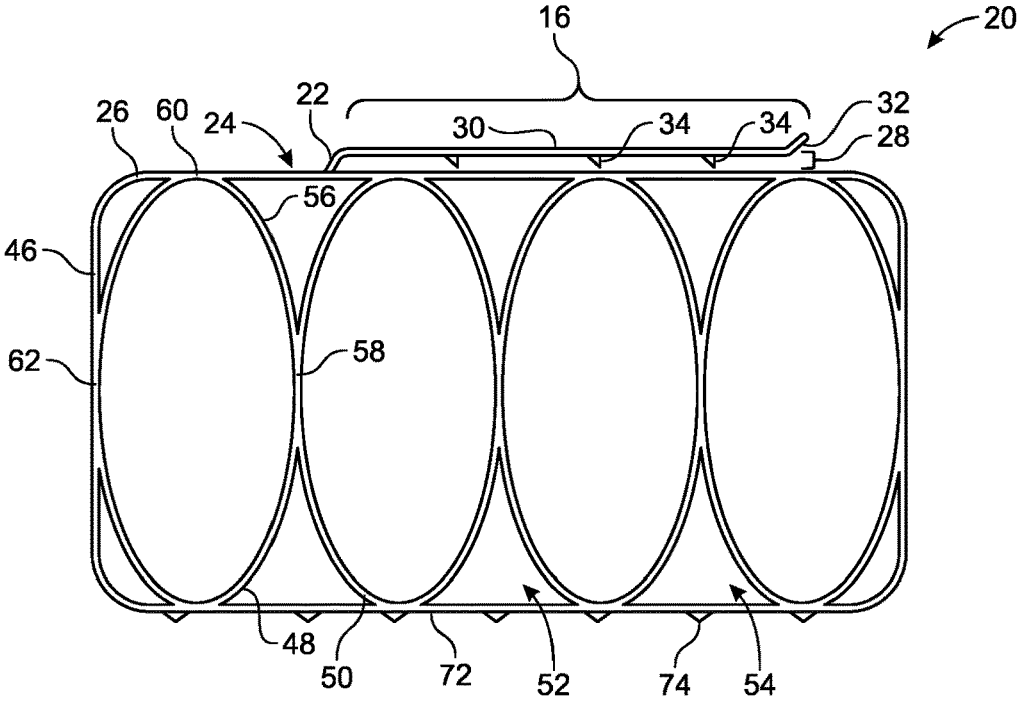
FIG. 4 is a side plan view of the pallet blocks shown in FIGS. 1 and 2.
Figure 5:
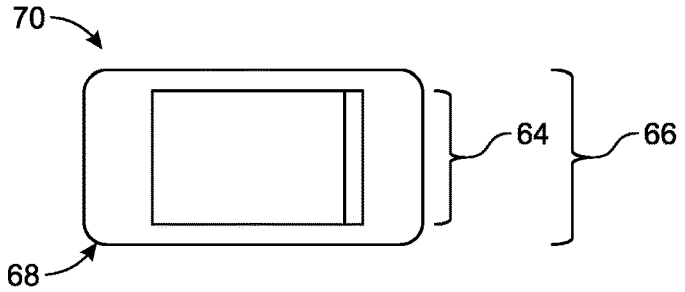
FIG. 5 is a top plan view of the pallet blocks shown in FIGS. 1, 2 and 4.

The pallet blocks 20 may also have unique feature(s) apart from the clamp 16 and its cooperation with a pallet tray 12. The pallet blocks 10 may have an enclosing member 26 which provides an outer perimeter 46 about absorbing members 48,50 and possibly others, such as 52,54, etc. The absorbing members 48-52 preferably have a loading perimeter 56 or shape which contacts the outer perimeter 46 of the enclosing member 26 directly as illustrated or indirectly at least under some loading conditions (i.e., there may be gaps in an unloaded configuration for at least some embodiments). The enclosing perimeter 46 forms a continuous shape such as substantially a rectangle having curved edges and assists in retaining the shape of the absorbing members during loading. The wall thickness of the absorbing members 48-52 and/or enclosing member 26 can be relatively thin (such as 90/1000) and may be made of regrind, which when provided as a prototype of the construction shown in FIG. 4 supported a weight exceeding 200 pounds of load per pallet block 20. Remember, the pallet blocks 20 are preferably injection molded and many embodiments have a substantially uniform cross section as seen in FIG. 4 and others.

Adjacent absorbing members 48,50 and/or others may share a portion of center wall 58 which may form a portion of loading perimeter 56 of either of the absorbing members 48,50, etc. or not In this manner the adjacent absorbing members 48,50 may be integral to one another for at least some of the absorbing members 48,50. Not all absorbing members 48-52, etc. must interconnect as shown for all embodiments.

Additionally, at least some of the absorbing members 48,50 may interconnect or be integral with outer perimeter 46 of the enclosing member 26 such as at top wall portion 60 and/or side wall portion 62. As stated before, when using regrind, even at thin wall thicknesses, extremely strong pallet blocks 20 supporting a significant static load can be achieved.

The clamp 16 may extend a width 64 shorter than a width 66 of the enclosing member 26. The sides 68, 70 of the pallet block 20 may be left open for at least some embodiments to facilitate an ease of manufacture. The embodiment shown can be easily extruded from regrind or manufactured through other techniques and/or materials.

The loading perimeters 56 of absorbing members 48,50, etc., being constrained within (or a portion thereof as connected to) outer perimeter 26 of enclosing member 46 is believed to be novel and provide an effective load bearing pallet block 20 for at least some embodiments. Bottom surface 72 of enclosing member 46 may provide a textured surface, such as being sandblasted or otherwise, possibly having ridges 74 or other structure extending therefrom.

Figure 9:
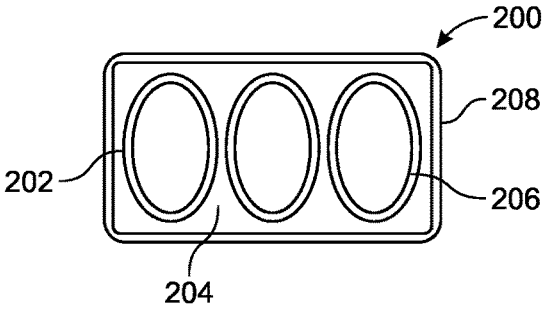
FIG. 9 is a side plan view of a first alternatively preferred embodiment.

FIG. 9 shows an alternative preferred embodiment of a pallet block 200 where the absorbing members 202,204,206 etc. do not have shared wall perimeter portions with each other and possibly not with portion(s) of enclosing member 208. The absorbing members 202-206 preferably do contact (directly or indirectly) the enclosing member 208 when under load.

With the pallet blocks 20 connected to the pallet tray 12, an optional floor 18 may then be placed atop the pallet tray 12 on the loading surface 36 to provide support surface 76 for loading product thereon.

While the clamp 16 illustrated is a presently preferred construction, other clamps 16 or ways to connect the improved pallet blocks 20 to pallet trays 12 or other structures may be employed with still other embodiments.

Figure 10:
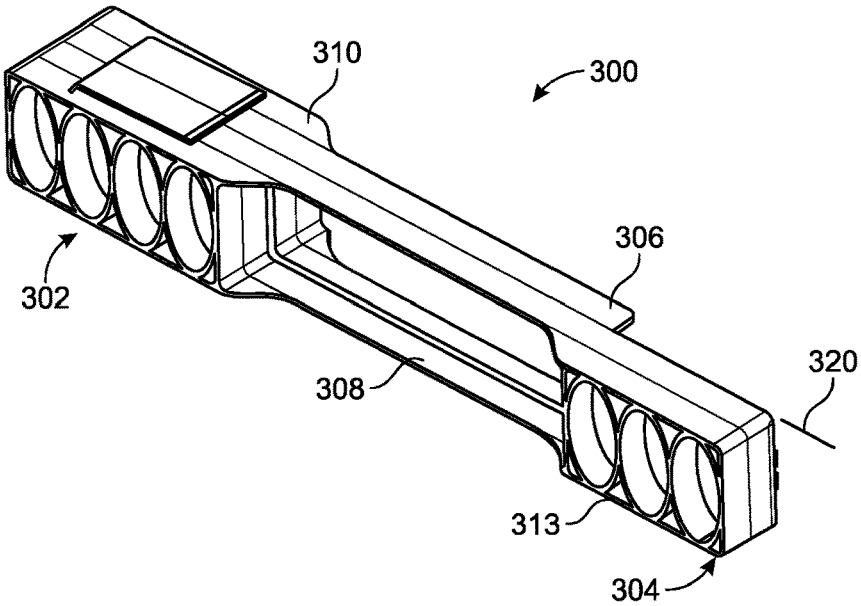
FIG. 10 is top perspective view of a second alternatively preferred embodiment
Figure 11:
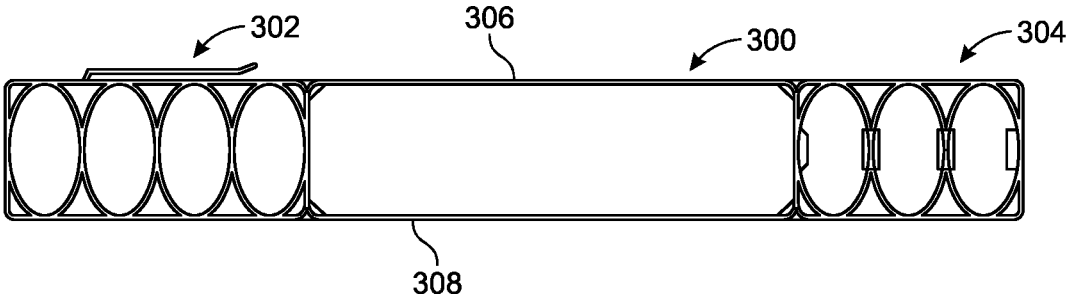
FIG. 11 is a front plan view of the embodiment of FIG. 10.
Figure 12:
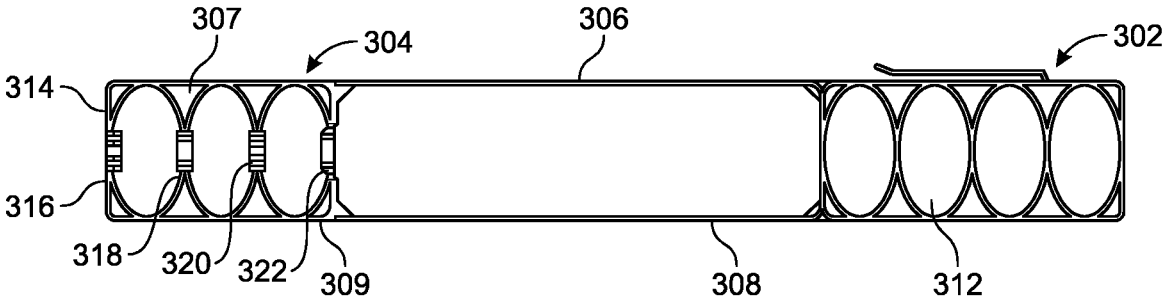
FIG. 12 is a rear plan view of the embodiment of FIG. 11.
Figure 13:
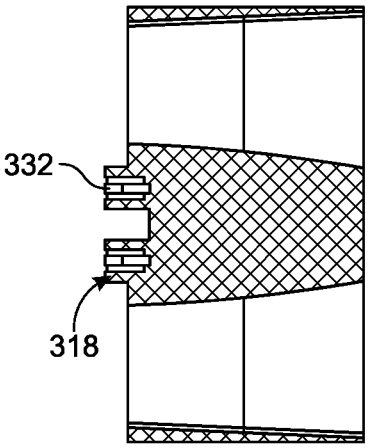
FIG. 13 is a cross sectional view taken along the line B-B of FIG. 11.
Figure 14:
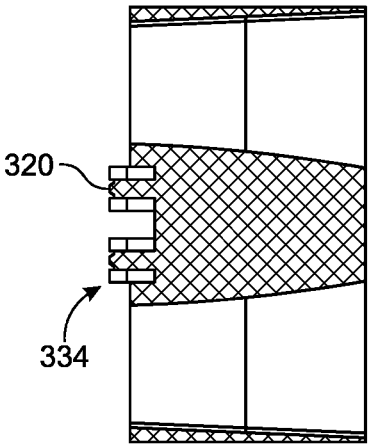
FIG. 14 is a cross sectional view taken along the line C-C of FIG. 11.

Pallet block segment 300 is shown in FIG. 10. This segment has a first pallet block 302 and a second pallet block 304 connected by upper and lower stringers 306, 308. Not all embodiments require both upper and lower stringers 306, 308, and still other embodiments may be constructed differently. First pallet block 302 may be similar to pallet block 20 in construction as illustrated, or not. However, what is different about pallet block segment 300 than pallet block 20 is the inclusion of the stringers 306, 308, which may be parallel to and/or unitary with upper surface 310 of first pallet block 302. Stringers 306, 308 may connect to second pallet block 304, possibly in an integrated manner at its upper and lower surfaces 307,309, which may be differently constructed than first pallet block 302. First pallet block 302 has clamp 303 similar to clamp 16 of FIG. 14 for at least some embodiments.

First, second pallet block 304 has three absorbing members 312 instead of four. However, second pallet block 304 may be formed to cooperate with a similar second pallet block 304 of a second pallet block segment 324, possibly connected thereto as will be described below.

Figure 15:
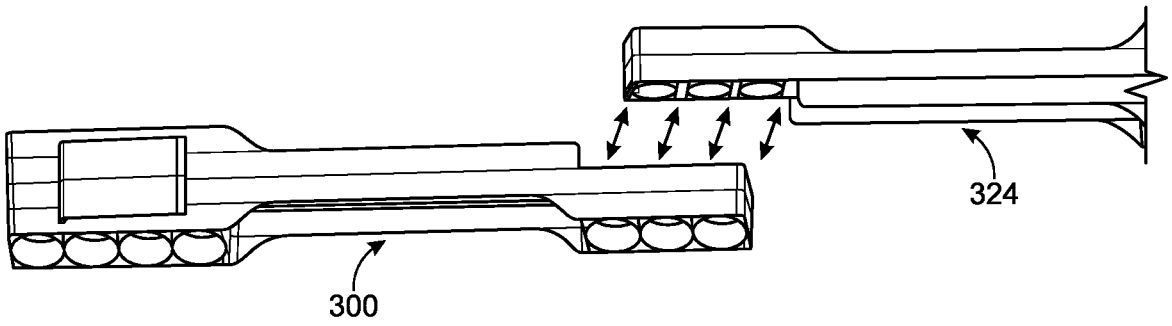
FIG. 15 is a top perspective view showing connection of two of the second alternatively preferred embodiments together.
Figure 16:
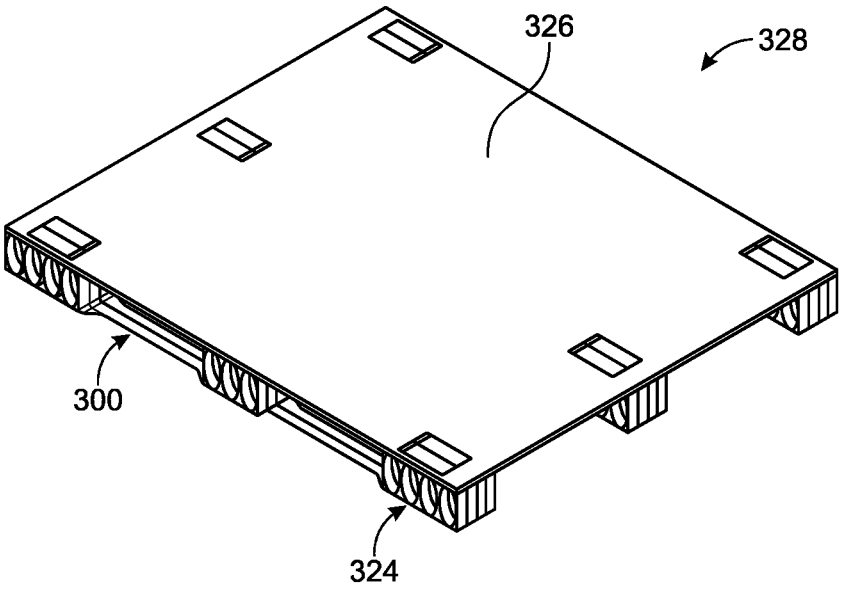
FIG. 16 is a top perspective view showing six of the second alternatively preferred embodiments connected in three pairs and coupled to a tray to form a pallet.

A rear face 314 of the second pallet block has first, second, third and fourth connectors 316,318,320,322. Other embodiments may have different or different number of connectors 316-322. A first connector 316 of a first pallet block 300 may connect to a fourth connector 320 of a second pallet block 324 as shown in FIG. 15, and vice versa. A second connector 318 of first pallet block segment 300 may connect to a third connector 320 of a second pallet block segment 324 as the rear faces 314 overlap as shown in FIGS. 15 and 16 for connection. With the first and second pallet block segments 300,324 connected, a tray 326 may be connected thereto (or otherwise each pallet block segment 300,324 may be separately connected to tray 326 first, and then to each other) to form pallet substitute 328, along with two other pairs of connected pallet block segments 300,324 or other number of pairs of connected pallet block segments 300,324, etc.

Second pallet blocks 304 are illustrated half as wide as first pallet blocks 302. However, as long as second pallet blocks 304 cooperate with one another when rotated 180 degrees, such as by having second pallet blocks start at centerline 330 (excluding portion(s) of connectors 316-320 that may extend past) and proceed outwardly, a satisfactory design can be achieved for many embodiments. Connectors 316-320 may have first hooks 332 that cooperate with second hooks 334 to interlock when connected (possibly with a snap fit), or otherwise connect together.

For at least some applications, empty containers such as pails 5 may be shipped to a customer on the pallet substitutes 10. The customer may reuse the pallet substitute 10 or it may be that they will be using traditional pallets with filled containers due to the added weight. That customer may send pallet blocks 20 back to the applicant for re-use with a new pallet tray 12 which is not a repair, but a remanufacture of a new pallet substitute 10. For closed loop systems, such as where a particular customer is supplied with product regularly, picking up the pallet blocks 20 for reuse may be relatively easy for all parties and assist in lower costs for at least some, if not all parties. Furthermore, even though the pallet trays 12 have slots therein, they could be reused by the customer with filled goods (just without the blocks connected thereto) on traditional pallets. They just would have slots therethrough which would not significantly diminish their re-use capability, if at all.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A pallet substitute comprising:

at least four first plastic pallet blocks having a top surface and a bottom; and a paperboard tray having a substantially planar bottom connected to and supported by the top surface of the first pallet blocks above the bottom of the first pallet blocks, wherein the first pallet blocks respectively comprise adjacent absorbing members having perimeters surrounded by a perimeter of an enclosing member, and at least a portion of the absorbing members is in one of direct and indirect contact with the enclosing member under a specified load, and wherein when under the specified load, at least portions of the absorbing members contact a top, bottom and sides of the enclosing member.

2. The pallet substitute of claim 1 wherein the absorbing members have a continuous perimeter and at least one of the absorbing members shares a portion of a common wall with the enclosing member.

3. The pallet substitute of claim 1 wherein the absorbing members are oval shaped throughout cross sections of the absorbing members.

4. The pallet substitute of claim 1 wherein the paperboard tray has slots, and the first pallet blocks have clamps, the clamps extending through the slots to at least assist in connecting the first pallet blocks to the paperboard tray.

5. The pallet substitute of claim 4 wherein the clamp connects to an upper surface of the pallet block.

6. The pallet substitute of claim 5 wherein a shoulder of the clamp extends upwardly from the upper surface of the pallet block to an arm and a portion of the paperboard tray is retained between the arm and the upper surface with the shoulder extending through the slot.

7. The pallet substitute of claim 1 further comprising at least one stringer connecting two first pallet blocks forming a first pallet block segment.

8. The pallet substitute of claim 7 wherein the at least one stringer further comprises an upper stringer extending from the upper surfaces of the first pallet blocks connected with the at least one stringer.

9. The pallet substitute of claim 8 wherein the paperboard tray is in contact with the upper stringer.

10. The pallet substitute of claim 7 further comprising a second pallet block segment similarly constructed as the first pallet block segment, and the first and second pallet block segments connect together below the paperboard tray to form a set.

11. The pallet substitute of claim 7 wherein the second pallet block segments of the set connect at centerline of the first pallet blocks.

12. A pallet substitute comprising:

at least four plastic pallet blocks having a top and a bottom; and a tray having a plurality of slots, and clamps respectively connected to the pallet blocks extending through the slots and at least assisting in connecting the pallet blocks to the tray, and the tray supported by the pallet blocks above a bottom of the pallet blocks, the first pallet blocks respectively comprising absorbing members having continuous perimeters surrounded by a perimeter of an enclosing member, and at least a portion of the absorbing members is in one of direct and indirect contact with the enclosing member under a specified load with the absorbing members and enclosing member sharing at least a portion of a common wall.

13. The pallet substitute of claim 12 wherein the clamps connect to an upper surface of the pallet block and a shoulder of the clamp extends upwardly from the upper surface of the pallet block to an arm and a portion of the paperboard tray is retained between the arm and the upper surface with the shoulder extending through the slot.

14. The pallet substitute of claim 12 further comprising at least one stringer extending between two first pallet blocks forming a first pallet block segment and the at least one stringer further comprises an upper stringer extending from the upper surface of the first pallet blocks and the paperboard tray is in contact with the upper stringer, and further comprising a second pallet block segment similarly constructed as the first pallet block segment, and the first and second pallet block segments connect adjacently together below the paperboard tray to form a set.

15. A The first pallet block for use in a pallet substitute comprising:

at least two hollow adjacently contacting absorbing members having perimeters surrounded by a perimeter of a hollow enclosing member forming a pallet block, and at least a portion of the absorbing members is in one of direct and indirect contact with the enclosing member under a specified load; and wherein the absorbing members have a continuous perimeter and at least one of the absorbing members shares a portion of a common wall with the enclosing member.

16. The first pallet block of claim 15 wherein an upper surface of the enclosing member has a clamp extending therefrom.

17. The first pallet block of claim 15 in combination with at least three similarly constructed first pallet blocks, and the first pallet blocks connect to a tray at upper surfaces of the enclosing members to form a pallet substitute.

18. The first pallet block of claim 15 in combination with a second pallet block connected to the first pallet block with a stringer extending from upper surfaces of the first and second pallet blocks.

* * * * *